US005652409A

United States Patent [19]

Thompson et al.

[11] Patent Number: 5,652,409

[45] Date of Patent: Jul. 29, 1997

[54] BISMUTH AND COPPER BALLISTIC MODIFIERS FOR DOUBLE BASE PROPELLANTS

[75] Inventors: Stephen B. Thompson, Sterling; John L. Goodwin, Springfield, both of Va.; Albert T. Camp, Welcome, Md.

[73] Assignee: The United States of America as represented by the Secretary of the Navy, Washington, D.C.

[21] Appl. No.: 605,816

[22] Filed: Feb. 23, 1996

[51] Int. Cl.[6] ..... C06B 45/10; C06B 25/26

[52] U.S. Cl. ..... 149/98; 149/17.8; 149/96; 149/97

[58] Field of Search ..... 149/19.8, 96, 98, 149/97

[56] References Cited

U.S. PATENT DOCUMENTS

| | | | |
|---|---|---|---|
| 4,202,714 | 5/1980 | Alley et al. | 149/109.4 |
| 4,243,444 | 1/1981 | Alley et al. | 149/98 |
| 4,420,350 | 12/1983 | Camp et al. | 179/98 |

FOREIGN PATENT DOCUMENTS 19544528 5/1996 Germany .

OTHER PUBLICATIONS

Neidert et al, *Chem. Abs.*, 121:283123, abstract of Proc., Annu. Meet.—Air Waste Manage. Assoc (1993) 86th (vol. 10), 93/WP/107.06, 16 pp.

Berteleau et al., *Chem. Abs.*, 125:62504, abstract of DE 19544528.

*Primary Examiner*—Edward A. Miller

*Attorney, Agent, or Firm*—John Forrest; Roger D. Johnson

[57] ABSTRACT

Double base propellants having a mixture of bismuth and copper salts of hydroxy-substituted benzoic acids added as burning rate (ballistic) modifiers.

12 Claims, 15 Drawing Sheets

BISMUTH AND COPPER BALLISTIC MODIFIERS FOR DOUBLE BASE PROPELLANTS

BACKGROUND OF THE INVENTION

The present invention relates to propellants and more particularly to burn rate modifiers for double base propellants.

A double base propellant has an energetic polymer, generally nitrocellulose, plasticized into a gel by an energetic plasticizer, generally nitroglycerine. Various additives are also included in the propellant to improve the mechanical or ballistic properties of the propellant. One such additive is termed a burn rate (or ballistic) modifier which alters the inherently high dependence of the burning rate on chamber temperature and especially chamber pressure.

The objective in burn rate modification of double base propellants is to obtain plateau or mesa burning over a desired range of pressure and burning rate level. These terms come from the shape of a log-log plot of the burn rate equation for double base propellants which is given as $r=CP^n$ or n log P+log C, wherein r is the burn rate, P is the combustion chamber pressure, C is a constant for a given propellant composition at a specific temperature, and n is a constant for on modified propellants but is a variable in modified propellants. Double base propellants with no burn rate modifiers have a constant slope, n, with a value around 0.8 to 0.9. The addition of burn rate modifiers lowers the slope and changes the burn rate over a certain range of pressure. Plateau type propellants are characterized by the pressure exponent n being less than 0.2 in certain regions of pressure. A well defined plateau would have the pressure exponent n being zero over a useful pressure range. Mesa type propellants are characterized by the pressure exponent n being less than zero in certain regions of pressure. These propellants are also relatively temperature insensitive over wider ranges of pressures. As such, it is possible to design a rocket motor or gas generator which provides steady gas output regardless of bulk temperature. Examples of such mesa type propellants are described in U.S. Pat. No. 3,138,499 by Camp, et al.

Unfortunately, the burn rate modifiers used in Camp et al ('499) must include lead salts. Double base propellant processing utilizing lead based compounds poses a hazard to the environment and to personnel in the workplace. The precursor to propellant is a water wet paste which is partially dried and plasticized into a colloidal sheet by rolling between heated calenders. It is likely that some amount of the lead compound is lost in the excess water during the rolling process and subsequently carried into the waste stream. While collection and treatment methods can help clean the wastewater and are in place for any foreign material that may enter the waste stream, the best approach is to replace the problematic compound. The lead hazards also exist for propellant scrap disposal and demilitarization of units. The use of lead salts also leads to health hazards caused by lead oxides in the exhaust gases.

What is needed is a method of producing plateau and mesa propellants without the use of lead compounds.

SUMMARY

Accordingly an object of this invention is to provide new burn rate (ballistic) modifiers for double base propellants.

Another object of this invention is to provide new burn rate modifiers that are lead-free.

Yet another object of this invention is to provide lead-free burn rate modifiers which will produce plateau and mesa burning double base propellants.

These and other objects of this invention are accomplished by providing a mixture of a bismuth salt of a hydroxy substituted benzoic acid and a copper salt or chelate of a hydroxy-substituted benzoic acid which is added to double base propellant compositions to produce plateau and mesa burning propellants.

DESCRIPTION

Figure 1:
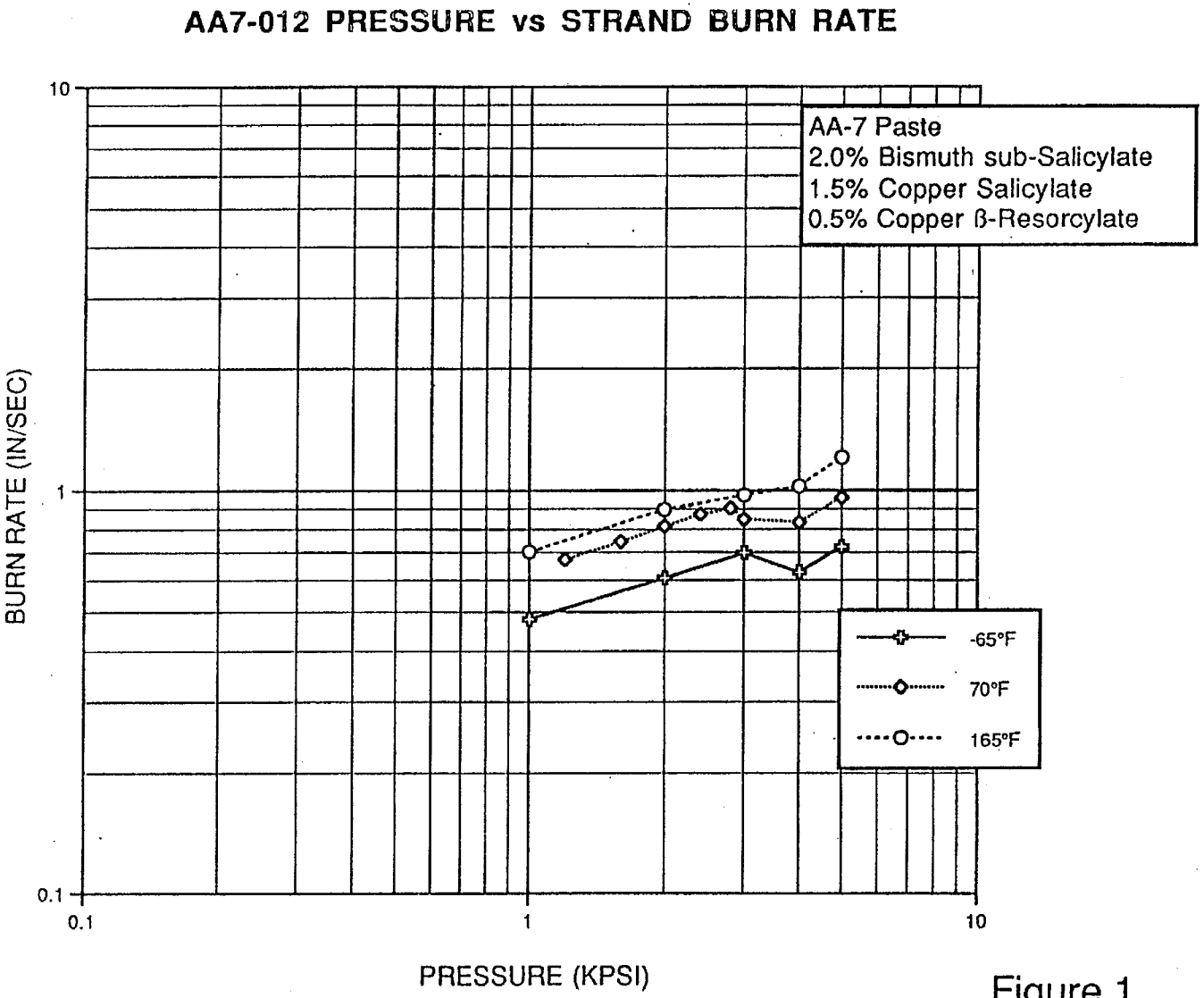
FIGS. 1 through 15 are graphs illustrating the pressure-burning rate relationships for various propellants tested. These graphs are discussed in the examples.

Mixtures of bismuth and copper salts of hydroxy substituted benzoic acids are added to double base propellants as burn rate (ballistic) modifiers to produce lead-free plateau or mesa type propellants.

The bismuth acid salts preferably include normal bismuth salicylate, monobasic bismuth salicylate (bismuth sub-salicylate), normal bismuth 3-hydroxybenzoate, monobasic bismuth 3-hydroxybenzoate, normal bismuth 4-hydroxybenzoate, monobasic bismuth 4-hydroxybenzoate, normal bismuth 2,4-dihydroxybenzoate (normal bismuth β-resorcylate), monobasic bismuth 2,4-dihydroxybenzoate (monobasic bismuth β-resorcylate), normal bismuth 2,5-dihydroxybenzoate, monobasic bismuth 2,5-dihydroxybenzoate, normal bismuth 2,6-dihydroxybenzoate, monobasic bismuth 2,6-dihydroxybenzoate, normal bismuth phenate, monobasic bismuth phenate, or mixtures thereof. The more preferred bismuth acid salts are normal bismuth salicylate, monobasic bismuth salicylate, normal bismuth 2,4-dihydroxybenzoate, monobasic bismuth 2,4-dihydroxybenzoate, or mixtures thereof, and still more preferred are normal bismuth salicylate, monobasic bismuth salicylate, or mixtures thereof. The monobasic bismuth acid salts are preferred over the corresponding normal bismuth acid salts. Thus, more preferred bismuth acid salts are monobasic bismuth salicylate (bismuth sub-salicylate), monobasic bismuth 3-hydroxybenzoate, monobasic bismuth 4-hydroxybenzoate, monobasic bismuth 2,4-dihydroxybenzoate (monobasic bismuth β-resorcylate), monobasic bismuth 2,5-dihydroxybenzoate, monobasic bismuth 2,6-dihydroxybenzoate, monobasic bismuth phenate, or mixtures thereof. Still more preferred bismuth acid salts are monobasic bismuth salicylate, monobasic bismuth 2,4-dihydroxybenzoate, or mixtures thereof, with monobasic bismuth salicylate being most preferred. The bismuth acid salt preferably comprises from about 0.5 to about 4, more preferably from 1.0 to 3.0, and still more preferably from 1.5 to 2.0 weight percent of the total double base propellant.

The copper acid salts preferably include normal copper salicylate, monobasic copper salicylate, normal copper 3-hydroxybenzoate, monobasic copper 3-hydroxybenzoate, normal copper 4-hydroxybenzoate, monobasic copper 4-hydroxybenzoate, normal copper 2,4-dihydroxybenzoate (normal copper β-resorcylate), monobasic copper 2,4-dihydroxybenzoate (monobasic copper β-resorcylate), normal copper 2,5-dihydroxybenzoate, monobasic copper 2,5-dihydroxybenzoate, normal copper 2,6-dihydroxybenzoate, monobasic copper 2,6-dihydroxybenzoate, copper (cupric) stannate, copper stearate, or mixtures thereof. The more preferred copper acid salts are normal copper salicylate, monobasic copper salicylate, normal copper 2,4-dihydroxybenzoate, monobasic copper 2,4-dihydroxybenzoate, or mixtures thereof. The monobasic copper acid salts are preferred over the corresponding normal copper acid salts. Thus, the more preferred copper acid salts are monobasic copper salicylate, monobasic copper 3-hydroxybenzoate, monobasic copper 4-hydroxybenzoate, monobasic copper 2,4-dihydroxybenzoate (monobasic copper β-resorcylate), monobasic copper 2,5-dihydroxybenzoate, monobasic copper 2,6-dihydroxybenzoate, or mixtures thereof. The still more preferred copper acid salts are monobasic copper salicylate, monobasic copper 2,4-dihydroxybenzoate, or mixtures thereof, with mixtures of monobasic copper salicylate and monobasic copper 2,4-dihydroxybenzoate being particularly preferred. The copper acid salt preferably comprises from about 0.5 to about 4, more preferably from 0.7 to 2.0, and still more preferably from 0.7 to 1.5 weight percent of the total double base propellant.

It is critical that a mixture of both the bismuth acid salt and the copper acid salt be used as the burn rate modifier. The bismuth acid salt used alone slows down the burn rate slightly but it does not produce a plateau or mesa effect. Similarly, the monobasic copper salicylate used alone slows down the burn rate but does not produce a plateau or mesa effect. Monobasic copper β-resorcylate (monobasic copper 2,4-dihydroxybenzoate) used alone does give a plateau and slight mesa but down in the range of 1 to 3 KPSI (see examples 11 and 12) which is too low for many applications. Certain aircrew escape propulsion systems (AEPS) for ejection seats, for example, require a pressure of from 3 to 5 KPSI. However, by using the bismuth acid salt in combination with the copper acid salt as a burn rate modifier, plateau and even more preferably mesa double base propellants are produced with plateaus and mesas above 3 KPSI. The role of bismuth sub-salicylate used in conjunction with the copper β-resorcylate and copper salicylate is to broaden the plateau beyond 3,000 psig. The combination also moves the mesa observed with the copper β-resorcylate alone to a higher pressure region and makes it more prominent.

Preferably at least one of the acid salts should be a monobasic acid salt. It does not matter whether it is a monobasic bismuth acid salt or a monobasic copper acid salt that is present. If only normal acid salts are used, they may breakdown to produce some of the corresponding free hydroxybenzoic acids which may catalyze the decomposition of the propellant. The presence of a monobasic acid salt prevents this and thus increases the life of the propellant.

The burn rate modifier of this invention is used to modify conventional double base propellants having an energetic binder and an energetic plasticizer. Typical energetic binders include nitrocellulose (NC) plastisol nitrocellulose (PNC), cyclodextrin nitrate (CDN) or mixtures thereof, with nitrocellulose, plastisol nitrocellulose, or mixtures thereof being preferred. Still more preferred is nitrocellulose and most preferred is nitrocellulose having a nitrogen content of from 12 to 13 weight percent.

The energetic plasticizer of the modified double base propellant may be a primary nitrate ester such as diethylene glycol dinitrate (DEGN), metriol trinitrate (MTN), triethylene glycol dinitrate (TEGDN), or mixtures thereof or a secondary nitrate ester such as nitroglycerin (NG), butanetriol trinitrate (BTTN), propylene glycol dinitrate (PGDN), or mixtures thereof, or mixtures of primary nitrate esters and secondary nitrate esters. The secondary nitrate esters are: more preferred with nitroglycerin being the most preferred energetic plasticizer because of low cost.

The addition of small amounts of carbon black to a propellant to enhance the mesa is a common industrial practice called "pressure broadening". The addition of from about 0.05 to 0.10 weight percent of carbon black broadens the plateaus and mesas of the propellants of this invention.

Finally, other conventional additives such as stabilizers and extrusion aids may be added to the propellants.

The modified propellants of this invention may be made by any of the well known conventional procedures. However, a solventless method is to be preferred over a solvent method of preparation. Solvents may have a detrimental effect on copper acid salts, particularly monobasic copper β-resorcylate. Solvent processes are also more time consuming and difficult due to the process of removing solvent from typically sized grains. Further, a solventless method gives a more homogeneous product. The solventless procedure described in U.S. Pat. No. 3,138,499 by Camp et al. is an example of this type of process.

The general nature of the invention having been set forth, the following examples are presented as specific illustrations thereof. It will be understood that the invention is not limited to these specific examples but is susceptible to various modifications that will be recognized by one of ordinary skill in the art.

In the following Table 1 and examples 1 through 15, all percentages are in weight percent unless otherwise specified.

Table 1 presents the propellant paste blends used to formulate the propellant composites of examples 1 through 15. The "paste" is the water wet combination of nitrocellulose, nitroglycerin, stabilizer, and inert plasticizer, but without burn rate (ballistic) modifying compounds. The various modifiers were added into the test batches from the original paste blend. The AA-7 paste blend is designed for a 2.75 inch rocket motor and the N-12 and IH-KU paste blends are intended for Aircrew Escape Propulsion Systems (AEPS). To achieve the desired ballistics the heat of explosion (HOE) should be higher than 900 calories per gram.

TABLE 1

| | Paste Blends (in weight percent) | | |
|---|---|---|---|
| | AA-7 Paste HOE = 1,000 cal/g | N-12 Paste HOE = 960 cal/g | IH-KU Paste HOE = 930 cal/g |
| Nitrocellulose (12.6% N) | 51.52 | 52.17 | 55.79 |
| Nitroglycerin | 40.40 | 39.64 | 34.67 |
| Di-normal-propyl adipate | 6.06 | 6.10 | 7.46 |
| 2-Nitrodiphenyl-amine | 2.02 | 2.09 | 2.09 |

Burn rate data for each example are presented in a log-log plot of the burn rate (inches per second) versus the pressure (KPSI or 1000 pounds per square inch). The initial temperature of the bulk propellant is also given. The figure number is the same as the number of the example.

Note that β-resorcylate is a common name for 2,4-dihydroxybenzoate and bismuth sub-salicylate is monobasic bismuth salicylate.

EXAMPLE 1

(See FIG. 1)

Propellant formulation AA7-012 was made of 2.0 weight percent bismuth sub-salicylate, 1.5 weight percent monobasic copper salicylate, 0.5 weight percent monobasic copper β-resorcylate, with the remainder of the formulation being the AA-7 paste listed in table 1. Burn tests were run for samples of AA7-012 having initial bulk propellant temperatures of −65° F., 77° F., and 165° F. and log-log plots of the burn rate (inches per second) versus pressure (KPSI) are shown in FIG. 1 the plots show a slight plateau and a mesa at 70° F. and 165° F. for this formulation, AA7-012.

EXAMPLE 2

Figure 2:
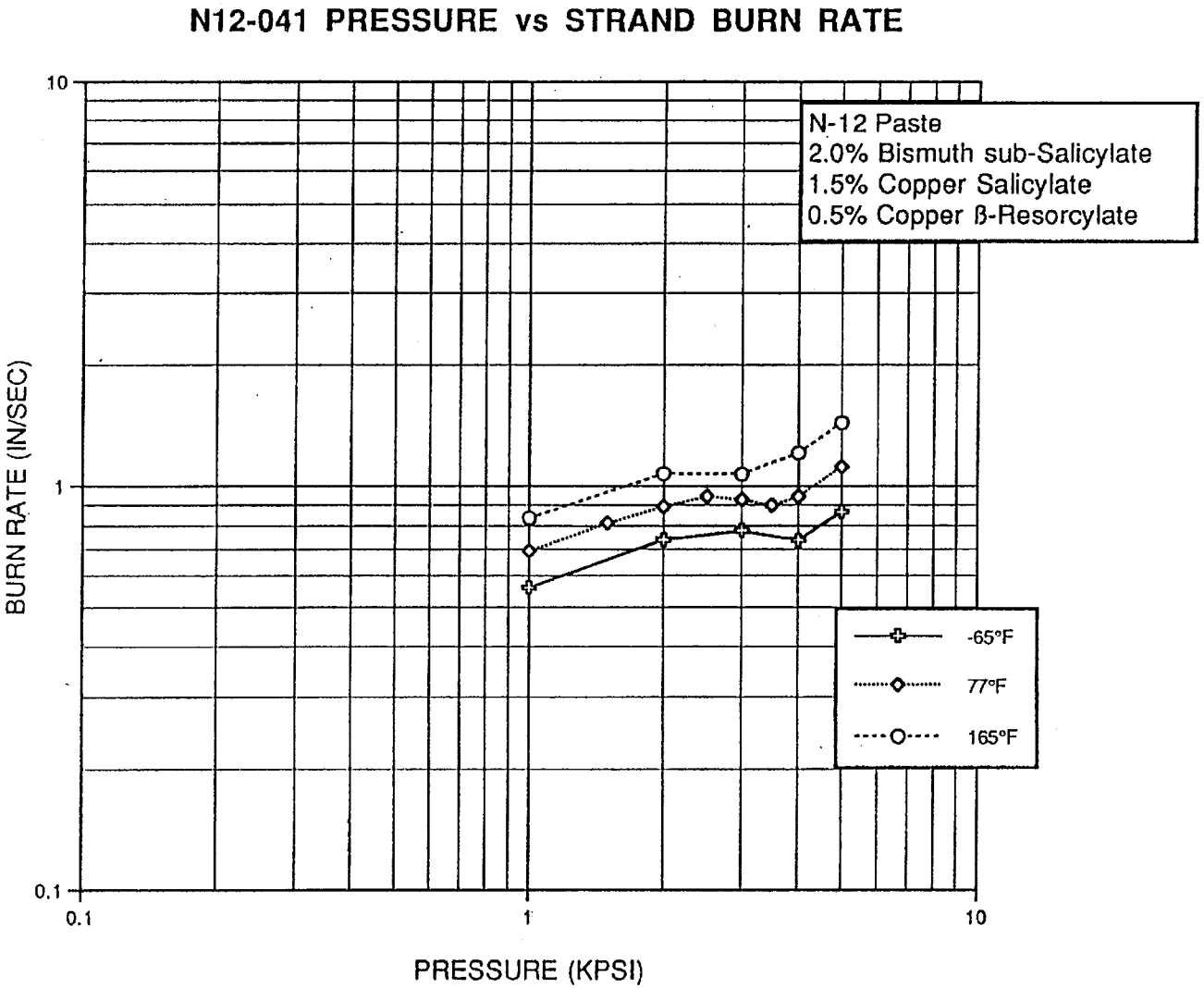

(See FIG. 2)

Propellant formulation N12-041 was made of 2.0 weight percent bismuth sub-salicylate, 1.5 weight percent monobasic copper salicylate, 0.5 weight percent monobasic copper β-resorcylate, with the remainder of the composite being the N-12 paste listed in table 1. Burn tests were run for samples of N12-041 having initial bulk propellant temperatures of −65° F., 77° F., and 165° C. and log-log plots of the burn rate versus pressure are shown in FIG. 2. The plots show a plateau at 165° F. and 77° F. and a slight mesa for this formulation to 3.5 KPSI at 77° F., N12-041.

EXAMPLE 3

Figure 3:
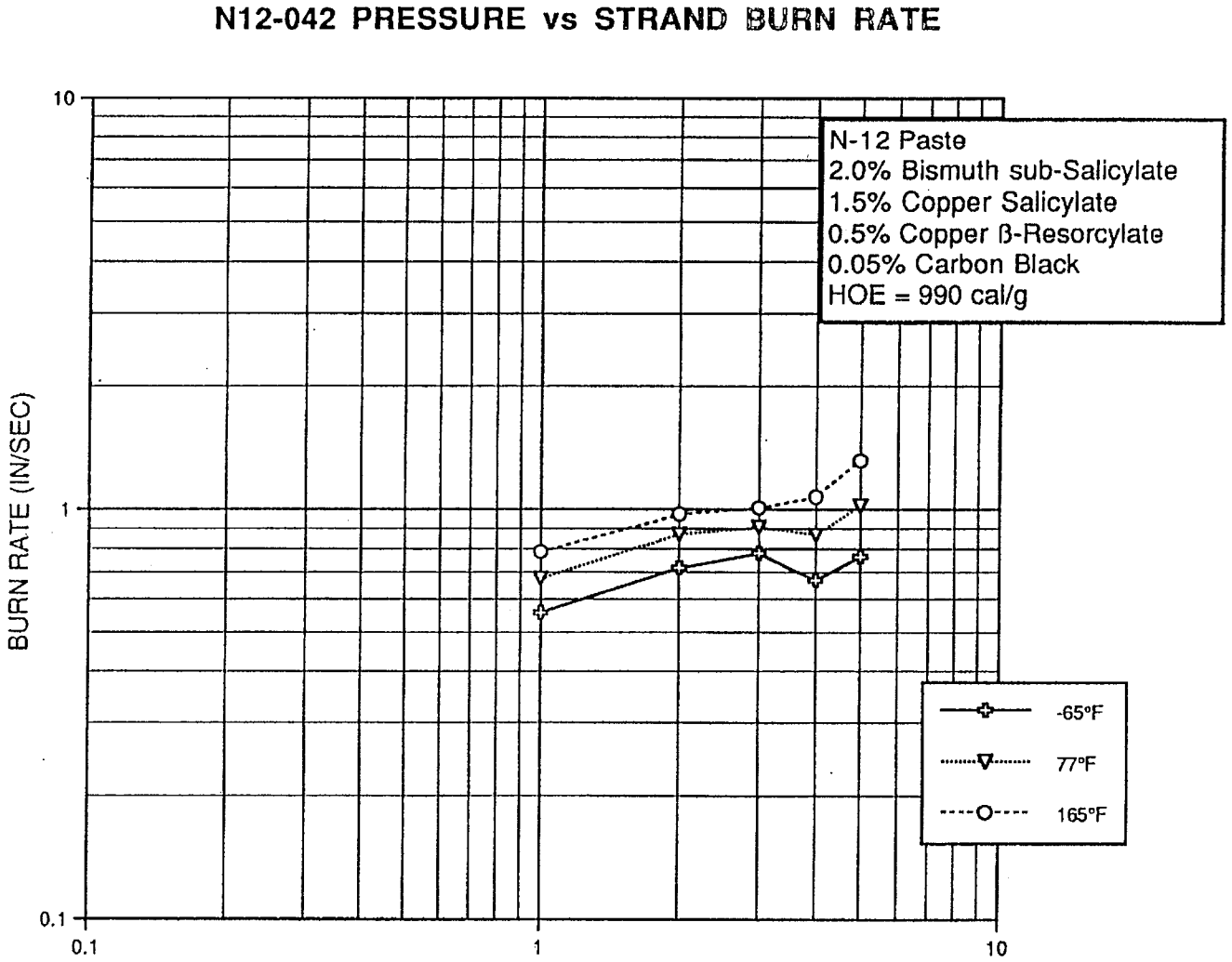

(See FIG. 3)

Propellant formulation N12-042 was the same as formulation N12-041 (example 2) except that 0.05 weight percent of carbon black was added. Burn tests were run for samples of N12-042 having initial bulk propellant temperatures of −65° F., 77° F., and 165° F. and log-log plots of the burn rate (inches per second) versus pressure (KPSI) are shown in FIG. 3. A comparison of FIGS. 2 and 3 shows that the addition of carbon black deepens the mesa.

EXAMPLE 4

Figure 4:
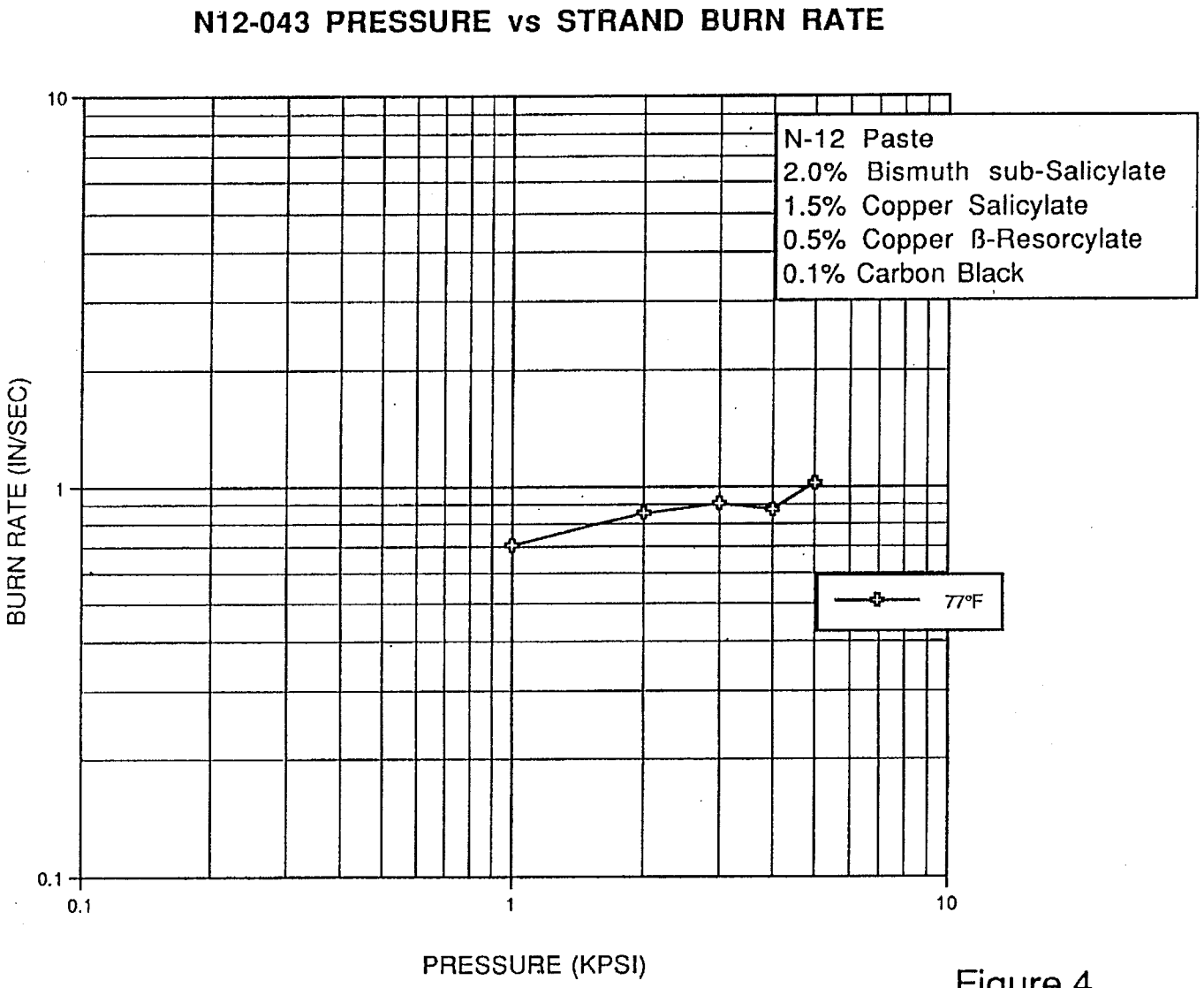

(See FIG. 4)

Propellant formulation N12-043 was the same as formulation N12-041 (example 2) except that 0.10 weight percent of carbon black was added. A burn test was run for a sample of N12-043 having initial bulk propellant temperatures of 77° F. and a log-log plot of the burn rate (inches per second) versus pressure (KPSI) is shown in FIG. 4. A comparison of FIGS. 2 and 4 shows that the addition of carbon black broadens the mesa to 4 KPSI at 77° F.

EXAMPLE 5

Figure 5:
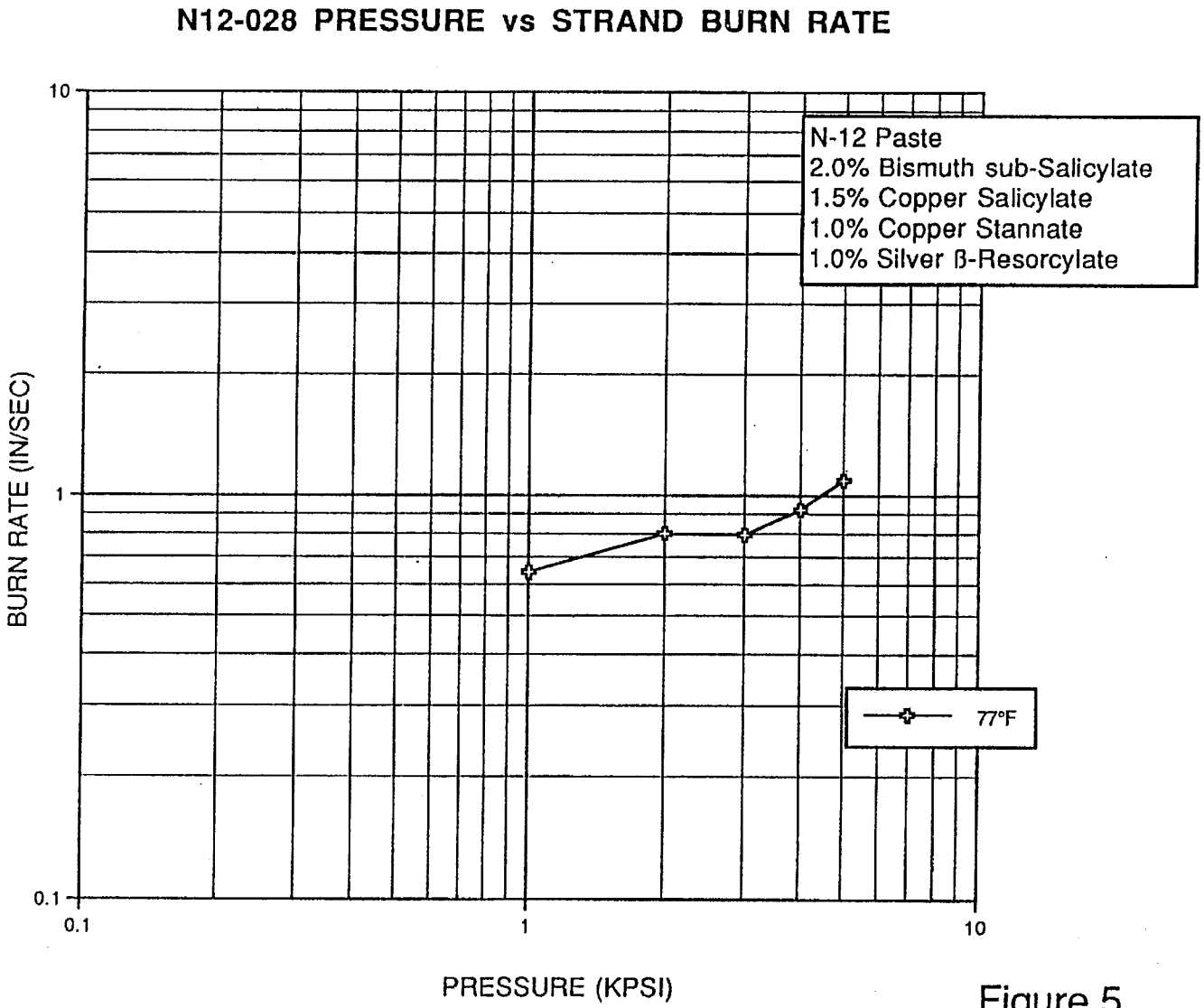

(See FIG. 5)

Propellant formulation N12-028 was made of 2.0 weight percent of bismuth sub-salicylate, 1.5 weight percent of monobasic copper salicylate, 1.0 weight percent of copper stannate, 1.0 weight percent of silver β-resorcylate, with the remainder of the formulation being the N-12 paste listed in Table 1. A burn test was run for a sample of N12-028 having an initial bulk propellant temperature of 77° F. and a log-log plot of the burn rate (inches per second) versus the pressure (KPSI) is shown in FIG. 5. The very slight mesa occurred at a lower pressure range (2 to 3 KPSI) at 77° F.

EXAMPLE 6

Figure 6:
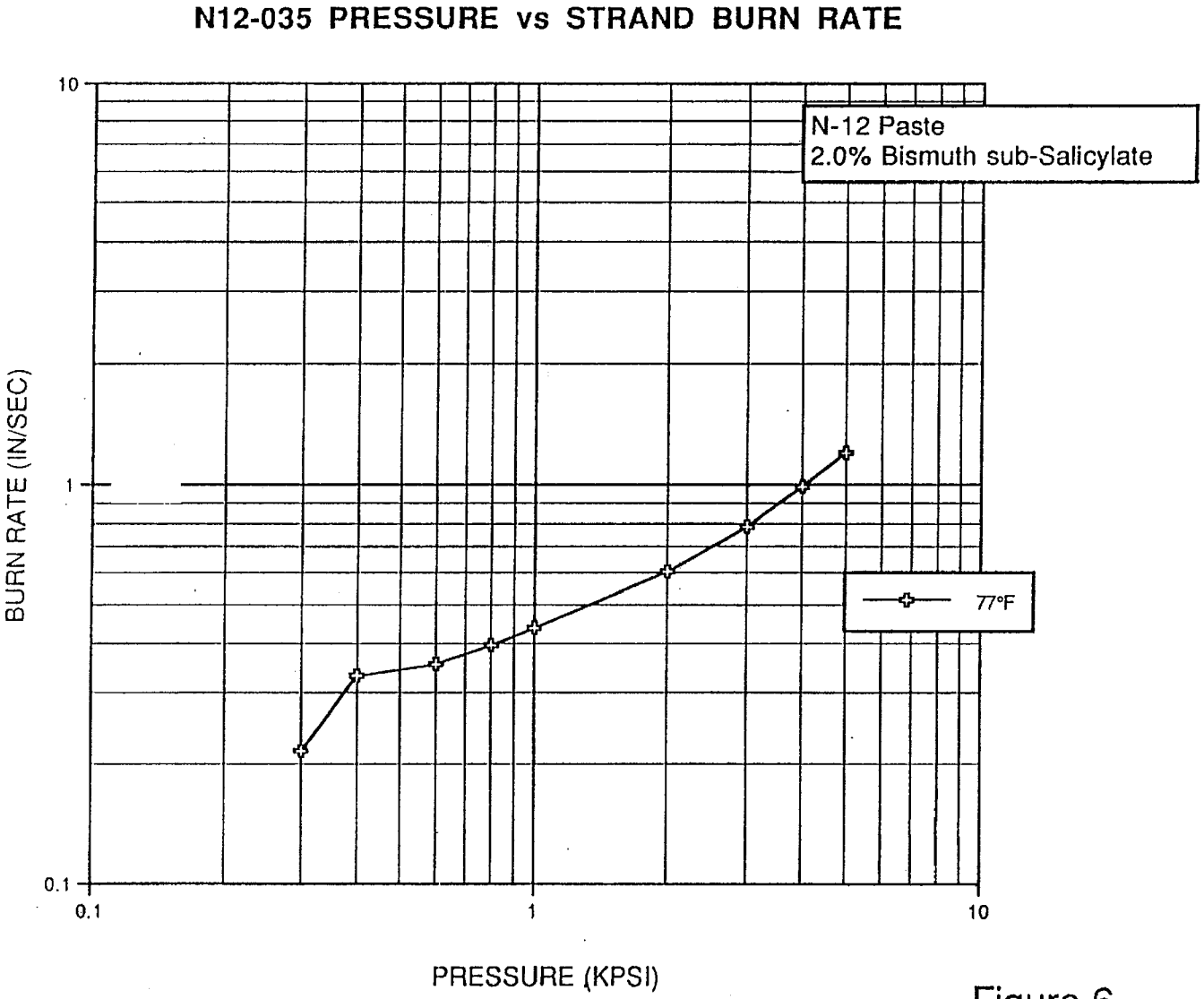

(See FIG. 6)

Propellant formulation N12-035 was made of 2.0 weight percent of bismuth sub-salicylate with the remainder of the formulation being the N-12 paste listed in Table 1. A burn test was run for a sample of N12-035 having an initial bulk propellant temperature of 77° F. and a log-log plot of the burn rate (inches per second) versus the pressure (KPSI) is shown in FIG. 6. No mesa was evident from 300 to 5000 psi, but a low slope plateau was evident from 400 to 600 psi. This example demonstrates that the use of bismuth acid salts alone will not produce the desired plateau and mesa effects.

EXAMPLE 7

Figure 7:
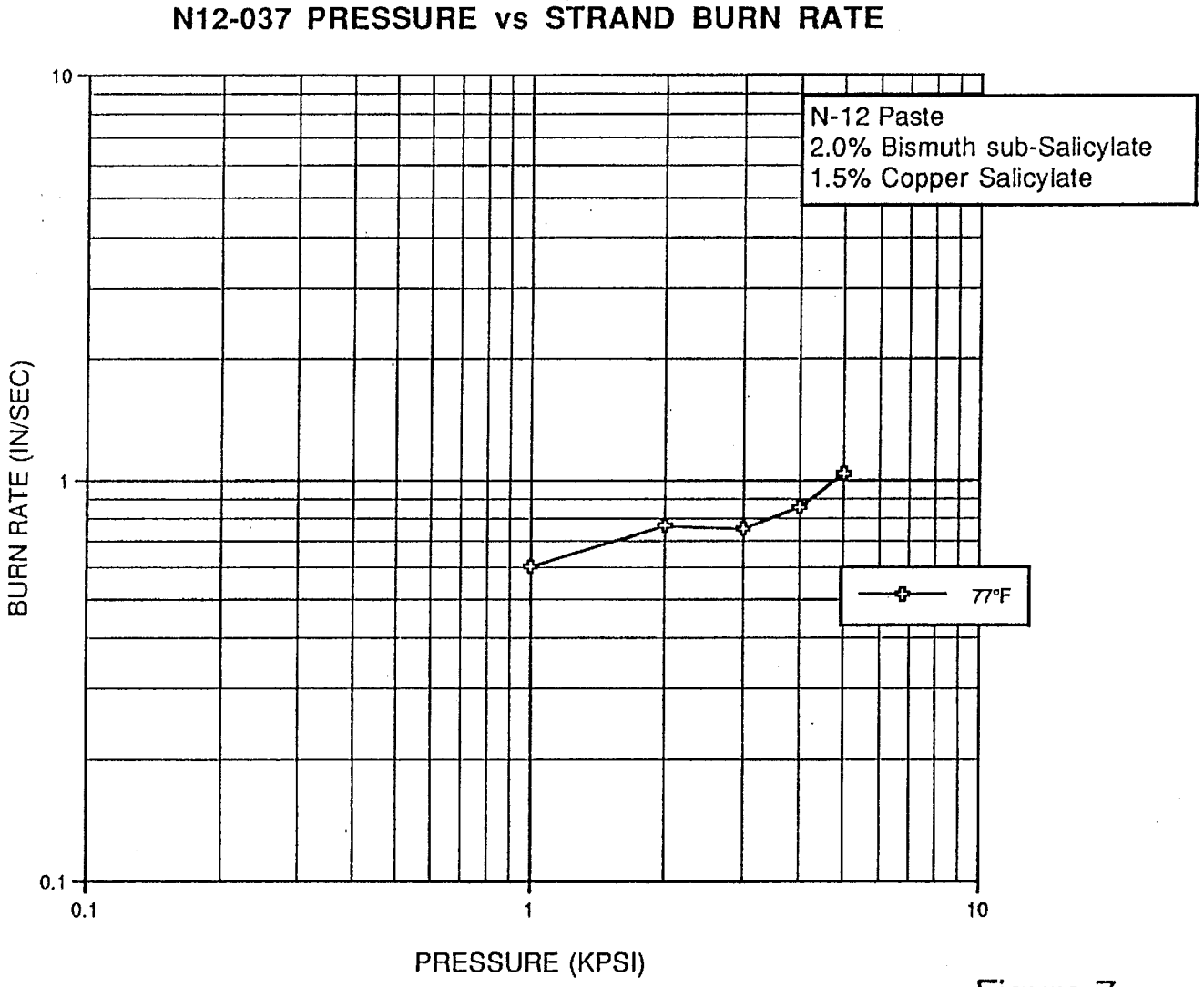

(See FIG. 7)

Propellant formulation N12-037 was made of 2.0 weight percent bismuth sub-salicylate, 1.5 weight percent monobasic copper salicylate, with the remainder of the formulation being the N-12 paste listed in table 1. A burn test was run for a sample of N12-037 having an initial bulk propellant temperature of 77° F. and a log-log plot of the burn rate (inches per second) versus the pressure (KPSI) is shown in FIG. 7. Again, the slight mesa was at a lower pressure range (2 to 3 KPSI).

EXAMPLE 8

Figure 8:
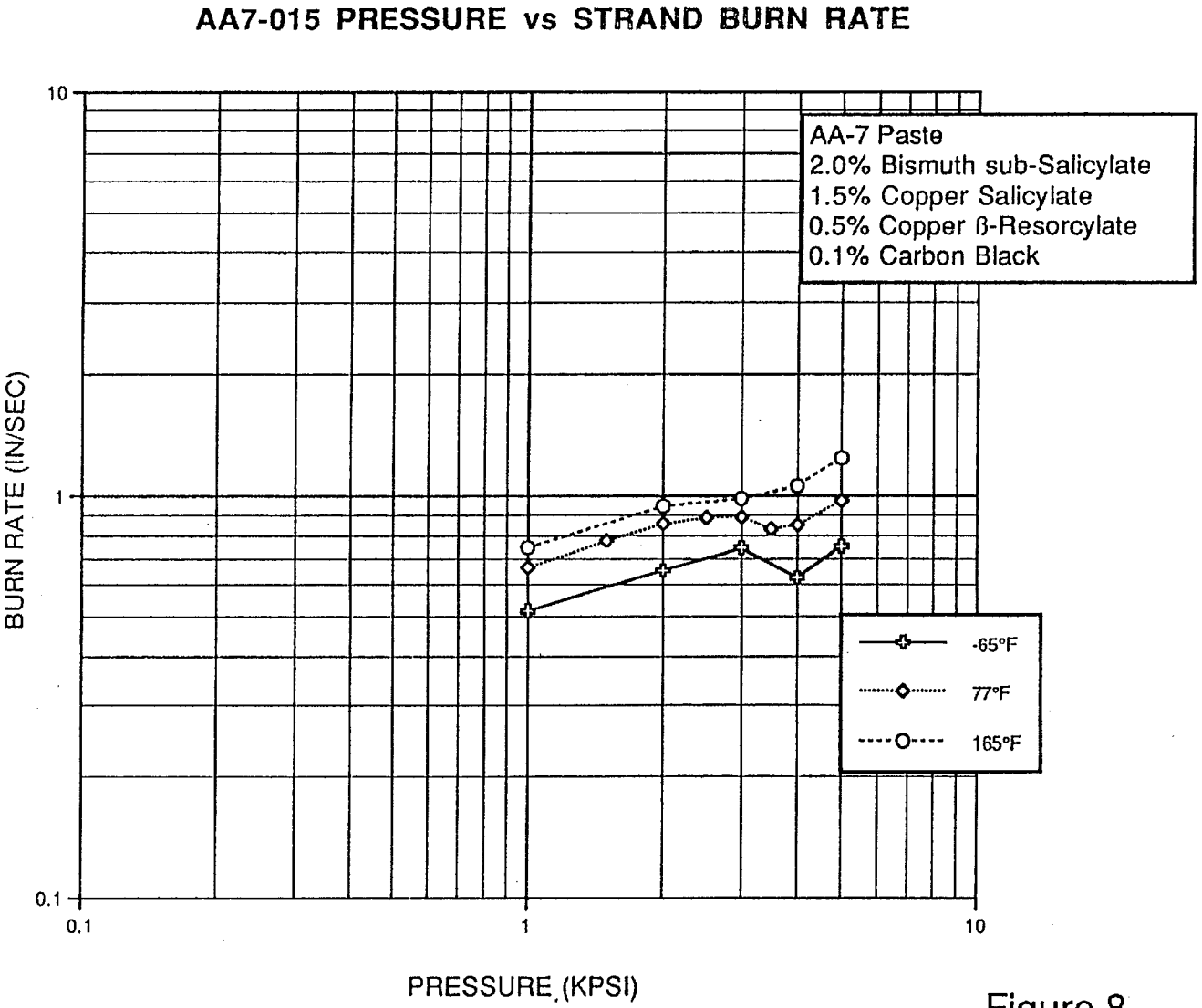

(See FIG. 8)

Propellant formulation AA7-015 was made of 2.0 weight percent bismuth sub-salicylate, 1.5 weight percent monobasic copper salicylate, 0.5 weight percent monobasic copper β-resorcylate, 0.1 weight percent carbon black, with the remainder of the formulation being the AA-7 paste listed in table 1. This AA7-015 formulation is the same as the AA7-012 formulation of example 1 except that 0.1 weight percent of carbon black was added. Burn tests were run for samples of AA7-015 having initial bulk propellant temperatures of −65° F., 77° F., and 165° F. and log-log of the burn rate (inches per second) versus the pressure (KPSI) are shown in FIG. 8. The results are comparable to those of formulation AA7-012 of example 1.

EXAMPLE 9

Figure 9:
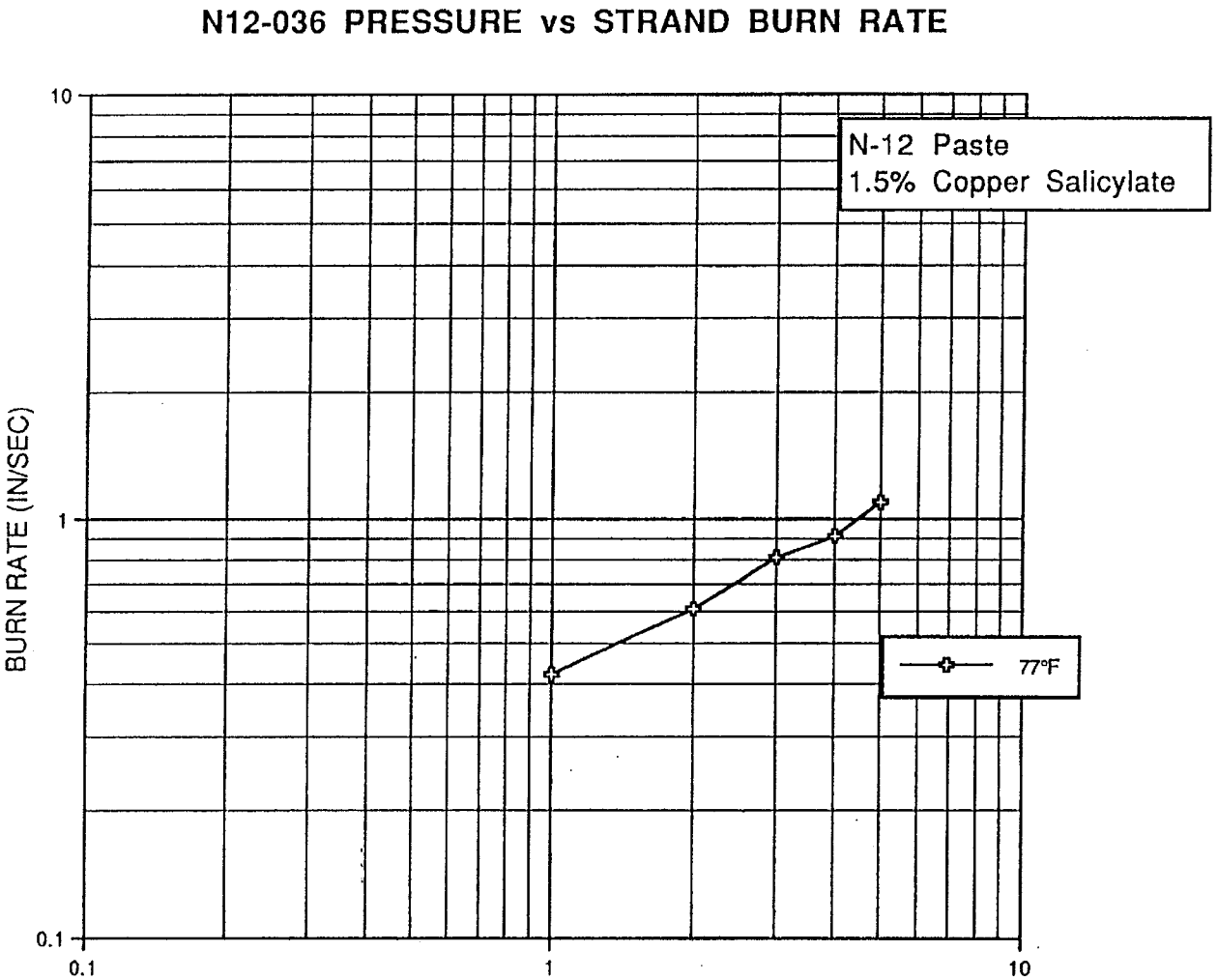

(See FIG. 9)

Propellant formulation N12-036 was made of 1.5 weight percent of monobasic copper salicylate with the remainder of the formulation being the N-12 paste listed in table 1. A burn test was run for a sample of N12-036 having an initial bulk propellant temperature of 77° F. and a log-log plot of the burn rate (inches per second) versus the pressure (KPSI) is shown in FIG. 9. The burn rate was lowered in the 3 to 5 KPSI pressure range without a plateau or a mesa.

EXAMPLE 10

Figure 10:
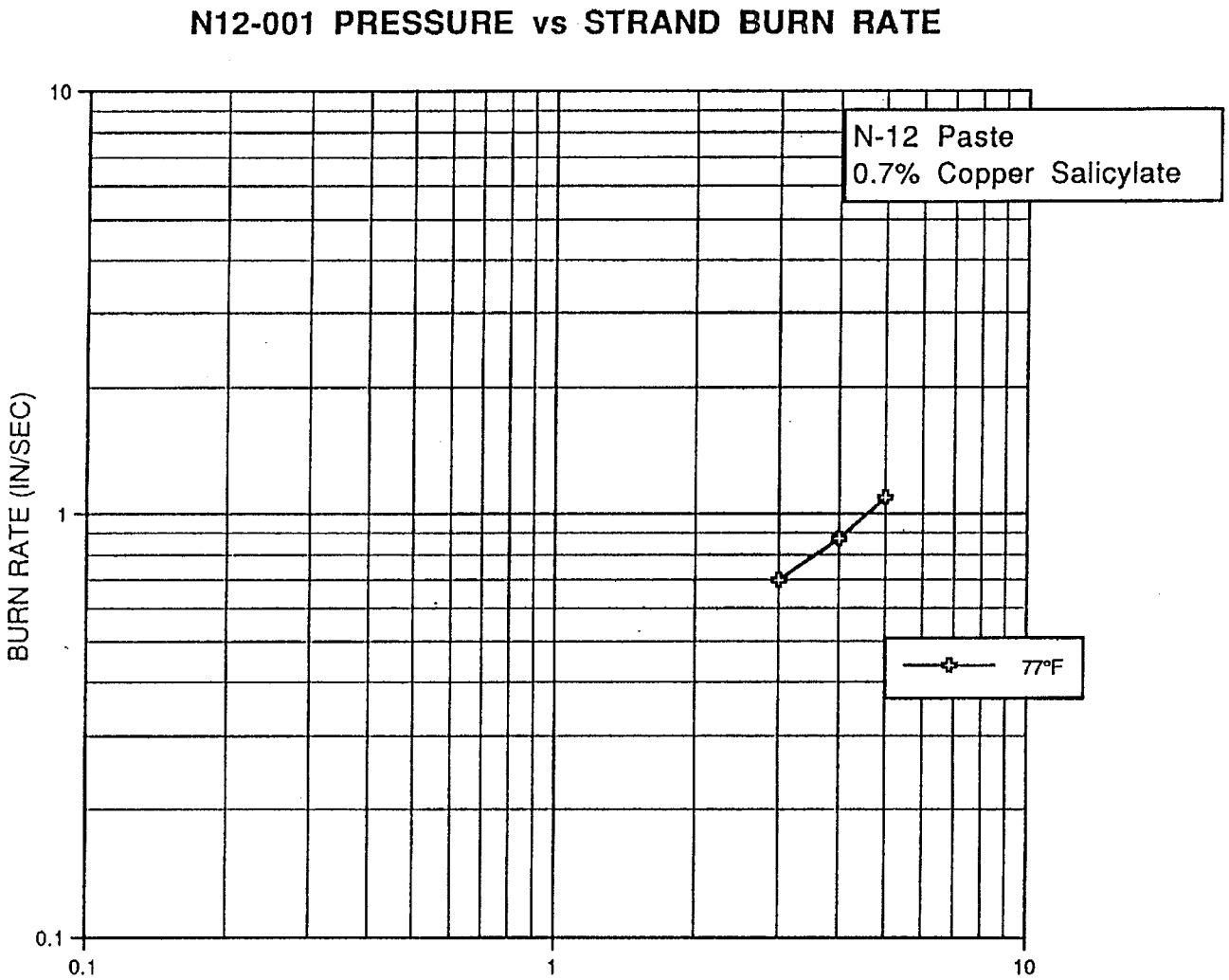

(See FIG. 10)

Propellant formulation N12-001 was made of 0.7 weight percent of monobasic copper salicylate with the remainder of the formulation being the N-12 paste listed in table 1. A burn test was run for a sample of N12-001 having an initial bulk propellant temperature of 77° F. and a log-log plot of the burn rate (inches per second) versus the pressure (KPSI) is shown in FIG. 10. Again, the burn rate was lowered in the 3 to 5 KPSI pressure range without a plateau or a mesa.

EXAMPLE 11

Figure 11:
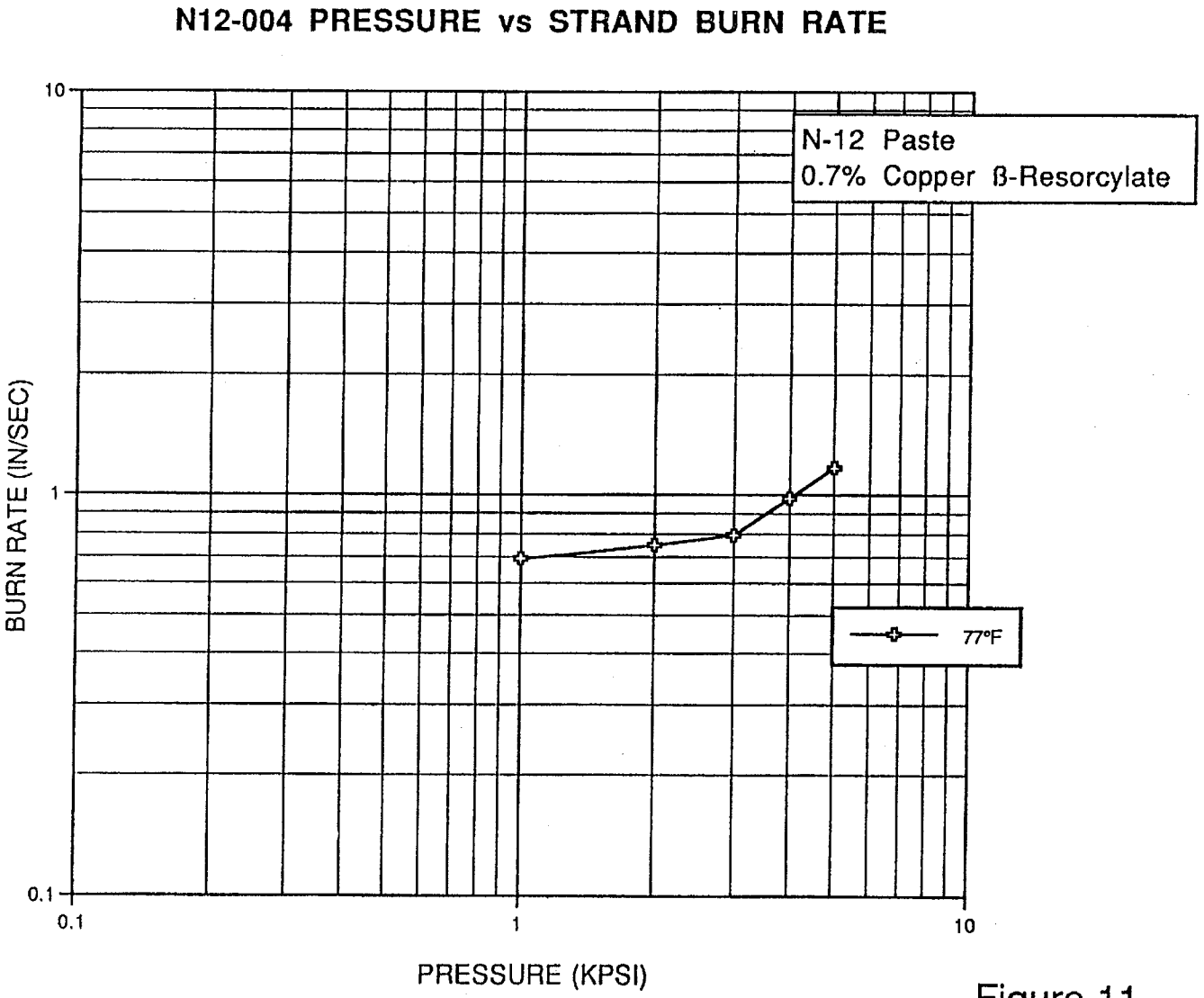

(See FIG. 11)

Propellant formulation N12-004 was made of 0.7 weight percent of monobasic copper β-resorcylate with the remainder of the formulation being the N-12 paste listed in table 1. A burn test was run for a sample of N12-004 having an initial bulk propellant temperature of 77° F. and a log-log plot of the burn rate (inches per second) versus the pressure (KPSI) is shown in FIG. 11. Again, the burn rate was lowered in the 3 to 5 KPSI pressure range but with a plateau in the pressure range of 1 to 3 KPSI which agrees with Camp et al. (U.S. Pat. No. 4,239,561).

EXAMPLE 12

Figure 12:
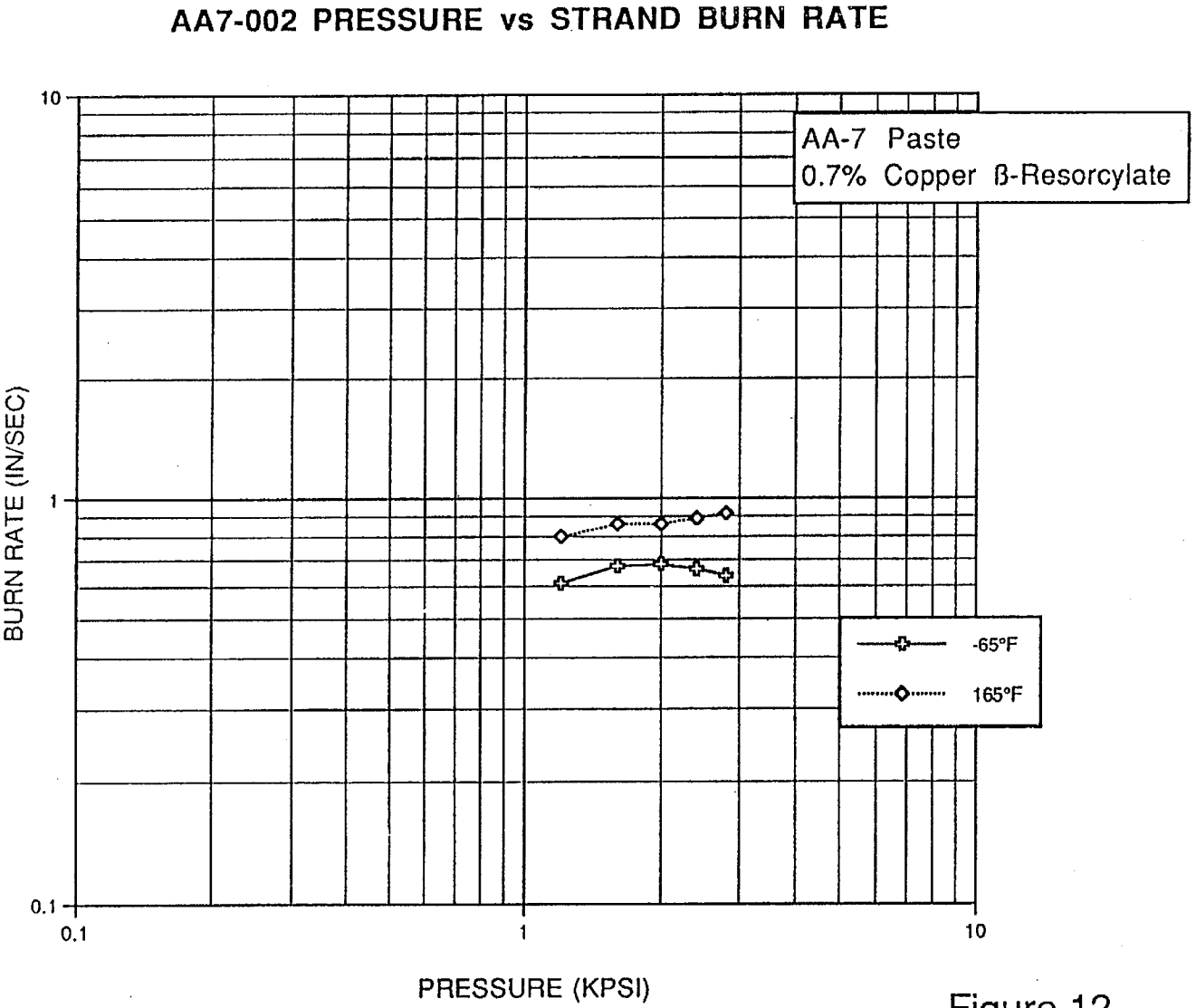

(See FIG. 12)

Propellant formulation AA7-002 was made of 0.7 weight percent of monobasic copper β-resorcylate with the remainder of the formulation being the AA-7 paste listed in table 1. Burn tests were run for samples of AA7-002 having initial bulk propellant temperatures of −65° F. and 165° F. and a log-log plot of the burn rate (inches per sec) versus the pressure (KPSI) is shown in FIG. 12. This re-affirms Camp et at. ('561) and indicates a plateau at both temperature extremes and a mesa at −65° F. Again the plateaus and mesa were down in the pressure range of 1 to 3 KPSI

EXAMPLE 13

Figure 13:
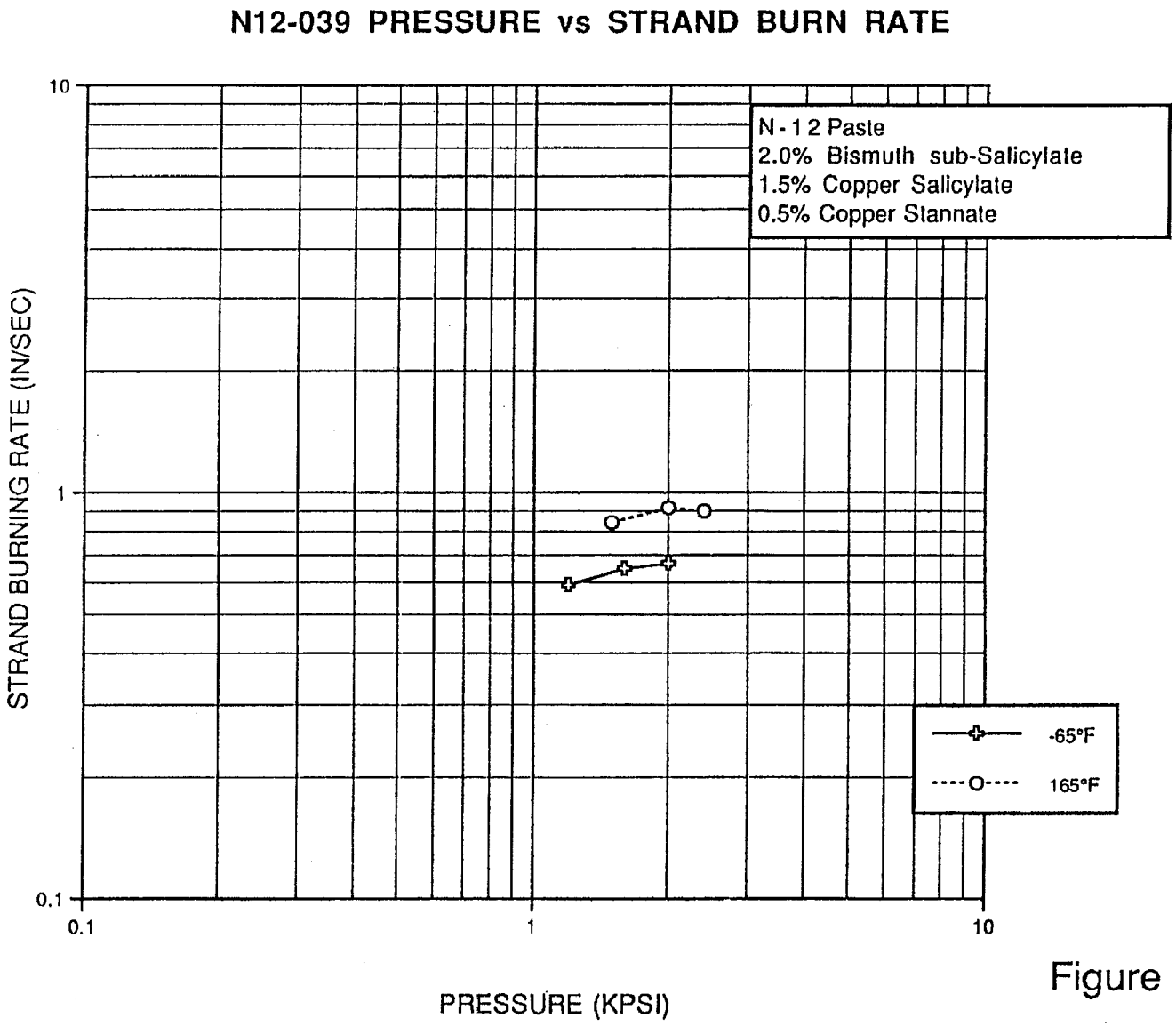

(See FIG. 13)

Propellant formulation N12-039 was made with 2 weight percent bismuth sub-salicylate, 1.5 weight percent monobasic copper salicylate, 0.5 weight percent copper stannate with the remainder being the N-12 paste listed in Table 1. Burn tests were run for samples of N-12-039 having initial bulk temperatures of −65° F. and 165° F. and log-log plots of the burn rate (in/sec) versus pressure (KPSI) are shown in FIG. 13. This shows a plateau at −65° F. and a mesa at 165° F.

EXAMPLE 14

Figure 14:
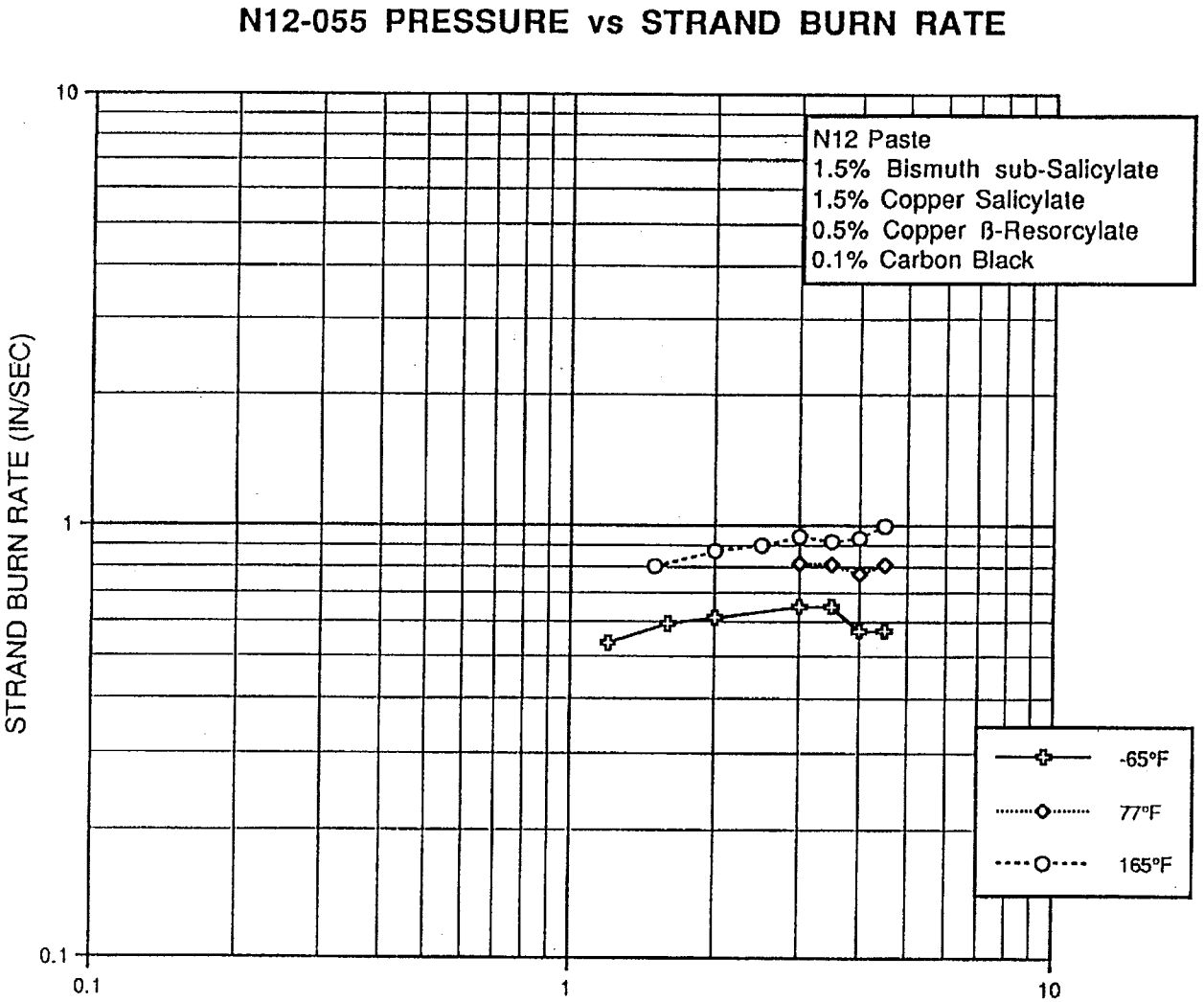

(See FIG. 14)

Propellant formulation N12-055 was made of 1.5 weight percent bismuth sub-salicylate, 1.5 weight percent monobasic copper salicylate, 0.5 weight percent monobasic copper 13-resorcylate, 0.1 weight percent carbon black with the remainder of the formulation being the N-12 paste listed in table 1. Burn tests were run for samples of N12-055 having initial bulk propellant temperatures of −65° F., 77° F., and 165° F. and log-log plots of the burn rate (inches per second) versus pressure (KPSI) are shown in FIG. 14. A plateau and mesa are evident at all three initial bulk temperatures.

EXAMPLE 15

Figure 15:
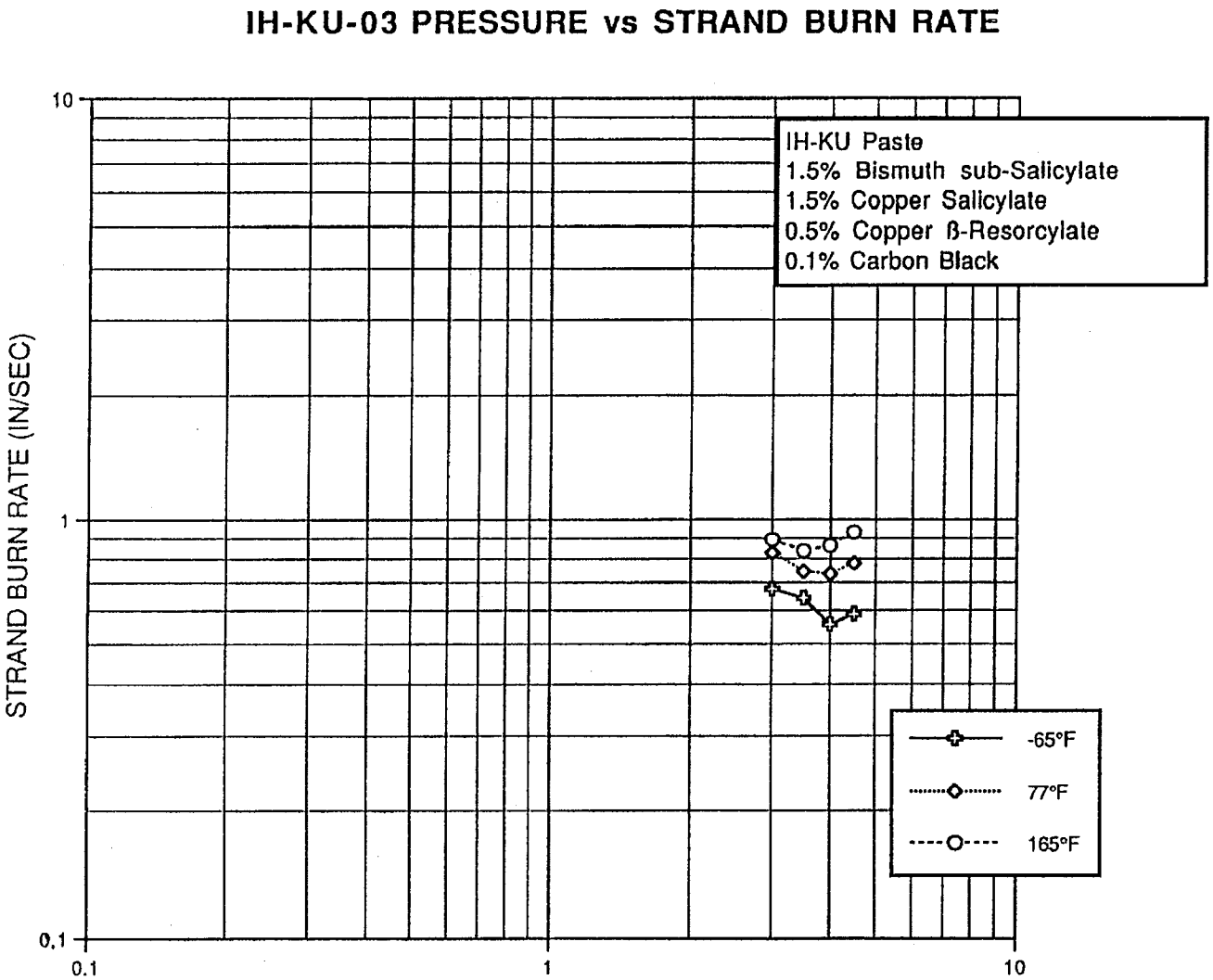

(See FIG. 15)

Propellant formulation IH-KU-03 was made of 1.5 weight percent bismuth sub-salicylate, 1.5 weight percent monobasic copper salicylate, 0.5 weight percent monobasic copper β-resorcylate, 0.1 weight percent carbon black with the remainder of the formulation being the IH-KU paste listed in table 1. Burn tests were run for samples of IH-KU-03 having initial bulk propellant temperatures of −65° F., 77° F., and 165° F. and log-log plots of the burn rate (inches per second) versus pressure (KPSI) are shown in FIG. 15. A very strong mesa occurs at all three initial bulk temperatures.

Obviously, numerous modifications and variations of the present invention are possible in light of the above teachings. It is therefore to be understood that, within the scope of the appended claims the invention may be practiced otherwise than as specifically described.

What is claimed is:

1. A double base propellant comprising an energetic polymer which is nitrocellulose, plastisol nitrocellulose, cyclodextrin nitrate, or mixtures thereof, an energetic plasticizer, and a burn rate modifier comprising a mixture of from about 0.5 to about 4 weight percent of a bismuth salt that is normal bismuth salicylate, monobasic bismuth salicylate, normal bismuth 3-hydroxybenzoate, monobasic bismuth 3-hydroxybenzoate, normal bismuth 4-hydroxybenzoate, monobasic bismuth 4-hydroxybenzoate, monobasic bismuth 2,4-dihydroxybenzoate, monobasic bismuth 2,5-dihydroxybenzoate, normal bismuth 2,6-dihydroxybenzoate, monobasic bismuth 2,6-dihydroxybenzoate, normal bismuth phenate, monobasic bismuth phenate, or mixtures thereof and from about 0.5 to about 4 weight percent of a copper salt that is a mixture of monobasic copper salicylate and monobasic copper 2,4-dihydroxybenzoate, wherein the weight percentages are based on the total weight of the propellant, and wherein the propellant exhibits a plateau or mesa burn rate at 3000 psi or higher.

2. The double base propellant of claim 1 wherein the bismuth salt is monobasic bismuth salicylate, monobasic bismuth 3-hydroxybenzoate, monobasic bismuth 4-hydroxybenzoate, monobasic bismuth 2,4-dihydroxybenzoate, monobasic bismuth 2,5-dihydroxybenzoate, monobasic bismuth 2,6-dihydroxybenzoate, monobasic bismuth phenate, or mixtures thereof.

3. The double base propellant of claim 1 wherein the energetic binder is nitrocellulose.

4. The double base propellant of claim 1 wherein the energetic plasticizer is a nitrate ester that is diethylene glycol dinitrate, metriol trinitrate, triethylene glycol dinitrate, nitroglycerin, butanetriol trinitrate, propylene glycol dinitrate or mixtures thereof.

5. The double base propellant of claim 4 wherein the energetic plasticizer is nitroglycerin.

6. The double base propellant of claim 1 wherein the bismuth salt is normal bismuth salicylate, monobasic bismuth salicylate, normal bismuth 2,4-dihydroxybenzoate, monobasic bismuth 2,4-dihydroxybenzoate, or mixtures thereof.

7. The double base propellant of claim 6 wherein the bismuth salt is monobasic bismuth salicylate, monobasic bismuth 2,4-dihydroxybenzoate, or mixtures thereof.

8. The double base propellant of claim 7 wherein the bismuth salt is monobasic bismuth salicylate.

9. The double base propellant of claim 1 wherein the bismuth salt comprises from 1.0 to 3.0 weight percent of the propellant.

10. The double base propellant of claim 9 wherein the bismuth salt comprises from 1.5 to 2.0 weight percent of the propellant.

11. The double base propellant of claim 1 wherein the copper salt comprises from 0.7 to 2.0 weight percent of the propellant.

12. The double base propellant of claim 1 which exhibits a plateau or mesa burn rate between 3000 and 5000 psi.

* * * * *